US010422609B2

(12) United States Patent
Raupp et al.

(10) Patent No.: US 10,422,609 B2
(45) Date of Patent: Sep. 24, 2019

(54) SMOKE MUNITION

(71) Applicant: RHEINMETALL WAFFE MUNITION GMBH, Unterluess (DE)

(72) Inventors: Karl Raupp, Neuenburg (DE); Lothar-Georg Kopp, Neuenburg (DE); Stefan Lauer, Freiburg (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 15/836,137

(22) Filed: Dec. 8, 2017

(65) Prior Publication Data

US 2018/0100725 A1 Apr. 12, 2018

Related U.S. Application Data

(63) Continuation of application No. PCT/EP2016/062299, filed on May 31, 2016.

(30) Foreign Application Priority Data

Jun. 8, 2015 (DE) ..... 20 2015 003 966 U

(51) Int. Cl.
*F42B 5/155* (2006.01)
*F42B 12/48* (2006.01)
(Continued)

(52) U.S. Cl.
CPC ..... *F42B 5/155* (2013.01); *F42B 12/48* (2013.01); *F42B 10/48* (2013.01); *F42B 12/34* (2013.01)

(58) Field of Classification Search
CPC ..... F42B 5/155; F42B 12/48; F42B 12/34; F42B 10/48
(Continued)

(56) References Cited

U.S. PATENT DOCUMENTS 2,055,277 A * 9/1936 Clauser ..... F42B 10/56 102/341
2,978,716 A * 4/1961 Jackson ..... B63B 51/04 102/334
(Continued)

FOREIGN PATENT DOCUMENTS

DE 102004047231 A1 4/2006
EP 2612101 A1 7/2013
WO WO2012028257 A1 3/2012

OTHER PUBLICATIONS

International Search Report dated Aug. 4, 2016 in corresponding application PCT/EP2016/062299.

*Primary Examiner* — Samir Abdosh
(74) *Attorney, Agent, or Firm* — Muncy, Geissler, Olds & Lowe, P.C.

(57) ABSTRACT

A smoke munition or smoke grenade which can be fired from a launcher, for example a grenade launcher, and has at least one active charge for producing smoke as a protection for ships. To achieve the effect that the active charge of the smoke grenade can be delivered quickly and safely for the ship's crew and the active compound thereof can be converted completely into smoke even after hitting the water, the invention proposes providing the active charge with a floating aid, which can be deployed before the active charge hits the water and prevents the active charge from sinking and prevents the active compound that produces the smoke from becoming wet.

12 Claims, 3 Drawing Sheets

(51) Int. Cl.
*F42B 10/48* (2006.01)
*F42B 12/34* (2006.01)

(58) Field of Classification Search
USPC ..... 102/334
See application file for complete search history.

(56) References Cited

U.S. PATENT DOCUMENTS 3,120,183 A * 2/1964 Wheelwright ..... B63B 51/04 102/334
3,427,973 A * 2/1969 Beers ..... F42B 12/48 102/334
3,685,450 A * 8/1972 Walbeck ..... F42B 5/155 102/334
3,759,216 A * 9/1973 Sanders ..... G08B 5/40 102/334
7,337,724 B2 * 3/2008 Sibum ..... F42B 12/48 102/334
8,783,183 B2 * 7/2014 Gaisbauer ..... C06B 45/00 102/288

* cited by examiner

SMOKE MUNITION

This nonprovisional application is a continuation of International Application No. PCT/EP2016/062299, which was filed on May 31, 2016, and which claims priority to German Patent Application No. 20 2015 003 966.9, which was filed in Germany on Jun. 8, 2015, and which are both herein incorporated by reference.

BACKGROUND OF THE INVENTION

Field of the Invention

The invention relates to active charges which can be fired from a launcher for producing smoke as a protection for ships. These are distinguished by the fact that the active charge(s) preferably become(s) buoyant even before it/they hit(s) the surface of the water. For this purpose, before hitting the water, a floating aid that prevents the active charge from sinking is activated. Therefore, after firing the active charge, the active compound is ignited and at about the same time a pyrotechnic charge actuator, which activates the gas-producing mixture of the floating aid that is likewise incorporated in a grenade (smoke grenade).

Description of the Background Art

A device and a method for producing an effective wall of smoke over the surface of water is disclosed by EP 2 612 101 A1, which is incorporated herein by reference. A active charge for producing a decoy target is described in DE 10 2004 047 231 B4, which corresponds to U.S. Pat. No. 8,783,183, which is incorporated herein by reference.

In the case of land-based craft (tanks, trucks, etc.), smoke munition is delivered as a visual or infrared screen in the direction of an enemy and prevents the enemy from having a visual sighting or detection on IR viewing devices. A device for creating multispectral walls of smoke is cited by WO 2012/028257 A1, which is incorporated herein by reference. The active charges of the smoke grenades normally come to lie in general on solid ground, so that the active compound can be converted completely into smoke.

When firing conventional smoke grenades from a ship, the active charge of the smoke grenade would sink after hitting the water. The smoke-producing active compound contained in the active charge would become wet and then could not be ignited. If the active compound had already been ignited before the active charge hits the water, it would be extinguished again.

In order therefore to achieve a smoke shield as a means for ships to protect themselves, usually buoyant smoke pots are thrown manually into the water by the ship's crew.

Apart from the fact that delivering smoke pots in such a way is laborious and involves dangers for the ship's crew, the achievable shroud of smoke around the ships is relatively imprecise.

SUMMARY OF THE INVENTION

It is therefore an object of the invention to provide a possible way in which the active charges can be delivered quickly and safely for the ship's crew and their active compound can be completely converted into smoke even after hitting the water.

An exemplary embodiment of the invention is based essentially on the idea of providing the active charge of a smoke grenade with a floating aid that can be deployed before the active charge hits the water and prevents the active charge from sinking and the smoke-producing active compound from becoming wet.

In an embodiment, the smoke grenade comprises a grenade casing for receiving the active charge with at least one active compound that produces smoke, wherein an igniting device for igniting an expulsion charge of the active charge and for igniting a first pyrotechnic delay element, which acts on a priming charge of the active compound, is arranged at the rear end of the grenade casing, seen in the firing direction. In the region of the front end of the grenade casing, it has a widening in the form of a housing for an inflatable floating aid of the active charge. This floating aid is formed in such a way that in the inflated state it prevents the active charge from sinking until the active compound that produces smoke has converted into smoke as completely as possible. For inflating the floating aid, a gas-producing mixture, which can be activated by the priming charge of the active compound by way of a second pyrotechnic delay element, is arranged inside the active charge. The floating aid is formed in such a way that it has in the inflated state a tire-shaped, sphere-shaped, cushion-shaped or similar form. The material of the floating aid may be for example an aramid fiber fabric.

To stabilize the floating aid, it has been found to be advantageous if, in the widening of the grenade casing in the form of a housing, a telescopic tube device having at least two cylindrical tubes initially adjoins the outer wall of the active compound in the pushed-together state. This telescopic tube device is enclosed by the inflatable floating aid and is non-positively connected to it in such a way that, when the floating aid inflates, the floating aid actuates the telescopic tube device into its pushed-apart state. The combustion products that produce the smoke of the active compound thereby escape into the outside atmosphere by way of the space inside the tubes of the telescopic tube device.

The active charge can contain a central middle tube of a heat-resistant material (for example steel), which extends in the longitudinal direction and can be enclosed by the active compound and in which the expulsion charge, the first pyrotechnic delay element and the priming charge are arranged axially one behind the other and which has at its front end an opening for the ignition of the second pyrotechnic delay element.

The buoyant munition can be fired from any discharger/launcher (for example 76 mm). The widening of the caliber necessary for the placement of the telescopic device and floating aid is for example located outside the launcher. The distance from the support point of the edge of the launcher (27; FIG. 1) to the outer rear end of the munition is the same or substantially the same as a conventional smoke munition, for example of 76 mm caliber.

A smoke grenade for the crew of a ship of which the active charge can be delivered quickly and safely and of which the active compound can be converted completely into smoke even after hitting the water is proposed, for which purpose the active charge is provided with a floating aid that deploys before the active charge hits the water and prevents the active charge from sinking and the active compound that produces smoke from becoming wet.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
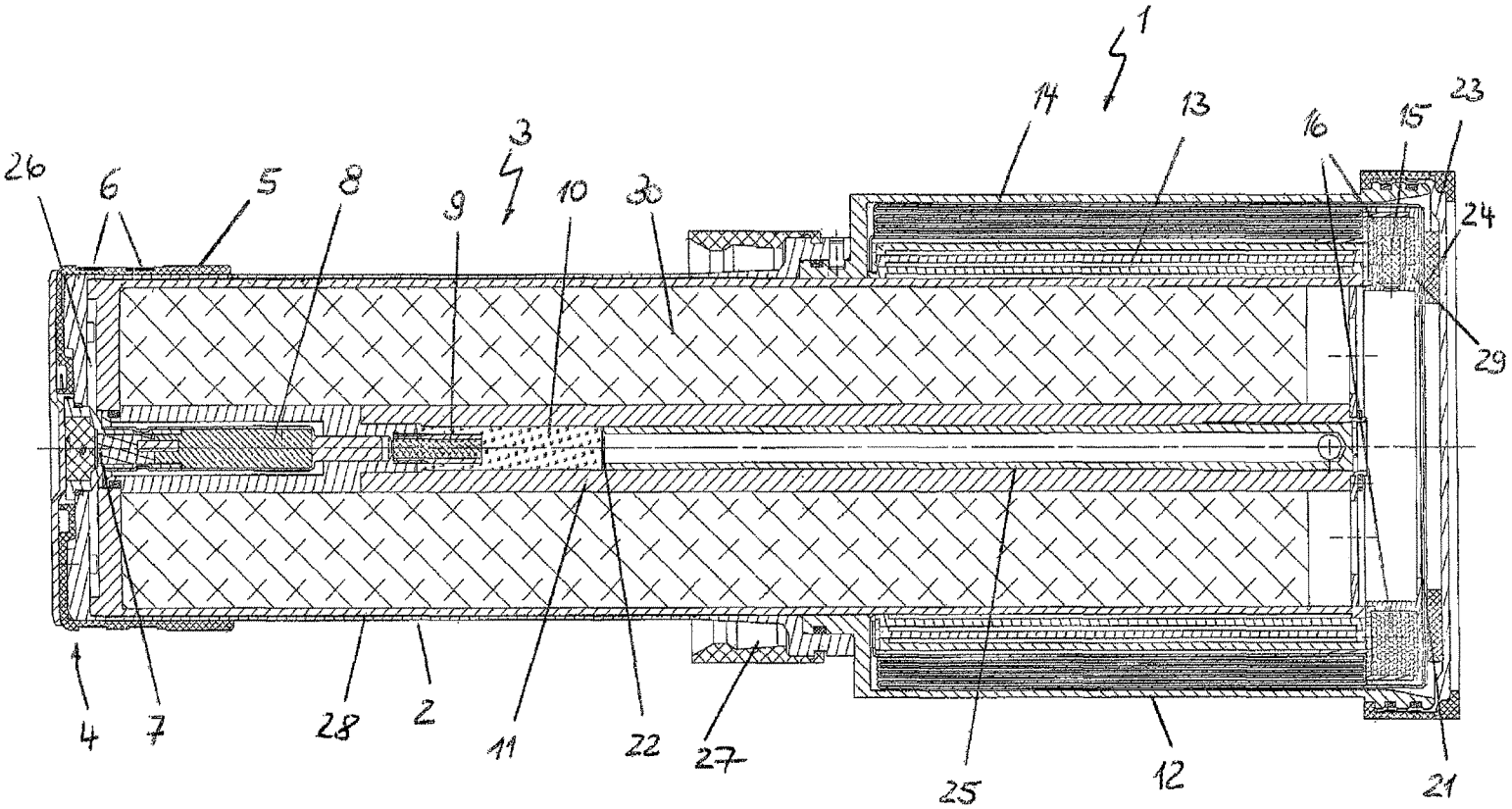
FIG. 1 shows a longitudinal section through a smoke grenade according to the invention with a smoke-producing active charge with a floating aid and a telescopic tube device before firing the active charge from a grenade launcher.

In FIG. 1, a smoke munition (smoke grenade) is denoted by 1, comprising a (grenade) casing 2 for receiving a smoke-producing active charge 3.

Provided at a rear end 4 of the casing 2, seen in the firing direction, is a contacting cup 5 with electrical contact rings 6. For electrical ignition, the contact rings 6 are connected to an igniting device 7, which for its part acts on an expulsion charge 8.

After ignition of the expulsion charge 8, the latter ignites a priming charge 10 of a smoke-producing active compound 30 by way of a first pyrotechnic delay element 9.

The expulsion charge 8, the first pyrotechnic delay element 9 and the priming charge 10 are arranged axially one behind the other in a central middle tube 11 (for example of steel) of the active charge 3. In the middle tube 11 there is on the side opposite from the delay element 9 a closing pin 25, on the end face of which there is a covering film 22. To avoid the priming charge 10 being able to become displaced, depending on the position of the munition, the closing pin 25 reaches with its covering film up to the priming charge 10.

On the front side, the casing 2 has a widening 12 in the form of a housing for receiving a telescopic tube device 13, formed, for example, of three cylindrical tubes, in the pushed-in state and a folded-up floating aid 14, enclosing the telescopic tube device 13. Also located in the front region of the active charge 3 is a gas-producing mixture 16, which can be ignited by a second pyrotechnic delay element 15. This mixture serves for producing gases for inflating the floating aid 14.

The functional sequence when firing the active charge 3 of the smoke grenade 1 according to the invention is discussed in more detail below with the aid of FIGS. 1-3.

If the active charge 3 of the smoke grenade 1 is to be fired, an igniting current is generated by the corresponding launcher (not represented) and the igniting device 7 is electrically ignited by way of the contact rings 6. This igniting device then ignites the expulsion charge 8, which provides the gas pressure required for the expulsion of the active charge 3 of the smoke munition 1 from the launcher. After the ignition of the expulsion charge 8, the gas enters a pressure chamber 26. Via the bottom of the can 28 of the active charge 3, the flux of force passes by way of a perforated disk 21 in a housing 29 of the gas-producing mixture 16 into the cover 23. When the required force is reached, the cover 23 is pushed out. The pressure building up consequently generates the force required to push off the cover 23 and accelerate the active charge 3 into the appropriate trajectory.

The expulsion charge 8 for its part ignites the first pyrotechnic delay element 9, which after the elapse of a predetermined time period during the flight of the active charge 3 ignites the priming charge 10, and consequently the active compound 30 that produces smoke. The ignition of the active compound 30 takes place by the hot gases produced by the priming charge 10. These gases pass through axial bores and transverse bores of the closing pin 25 (not represented any more specifically) and through congruent transverse bores of the middle tube 11 onto the end face of the active compound 30. On the active compound 30 there is an easily ignited pyrotechnic priming charge, which helps the active compound 30 to burn away at the end face. Furthermore, with the aid of the priming charge 10, the second pyrotechnic delay element 15 is also ignited by way of an opening 17 provided in the middle tube 11, at the front end, so that after the elapse of a predetermined time period the gases of the gas-producing mixture 16 fill the floating aid 14. This gas filling of the floating aid 14 has the effect that it expands during the flight of the active charge 3, for example into the shape of a cushion, and brings about an extension of the telescopic tubes of the telescopic tube device 13, through which the smoke 18 produced by the active compound 30 enters the surrounding atmosphere (FIG. 2).

Figure 2:
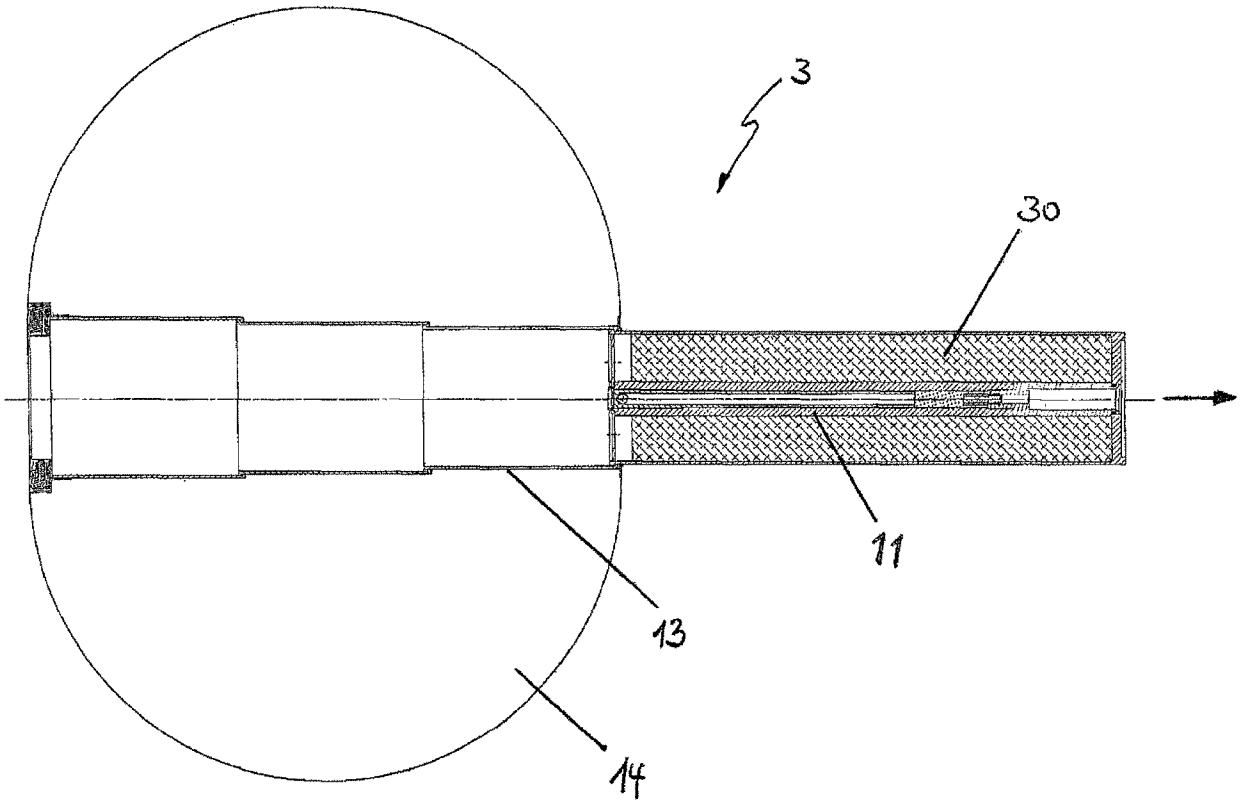
FIG. 2 shows a schematic representation of the active charge represented in FIG. 1 after being fired and the deployment of the floating aid, but before hitting a surface of water.

Since the active compound 30 that produces smoke 18 has a greater mass than the floating aid 14, including the telescopic tube device 13, during its flight the active charge 3 aligns itself in the way represented in FIG. 2, i.e. the active compound 30 is located in front of the floating aid 14 in the direction of flight. The active charge 3 then also hits the surface of the water 19 in this position.

Figure 3:
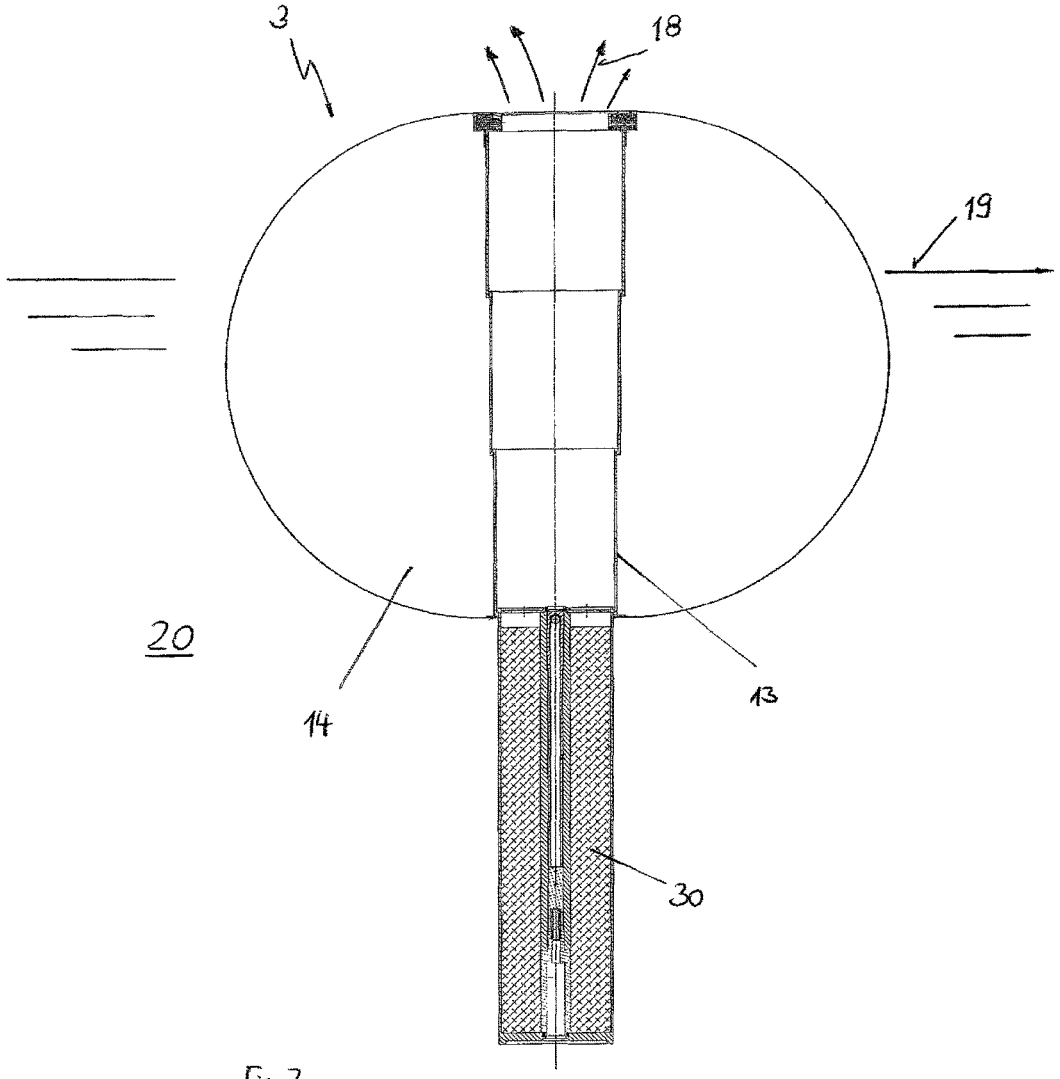
FIG. 3 shows the active charge represented in FIG. 2 after hitting the surface of the water.

Depending on the weight of the active compound 30 and the buoyancy of the floating aid 14, the active charge 3 sinks into the water 20 to a greater or lesser depth (FIG. 3). At the same time, the smoke produced by the active compound 30 continues to pass through the extended telescopic tubes of the telescopic tube device 13 into the air.

Even if the active charge 3 including the floating aid 14 is slightly below the surface of the water 19 because of the weight of the active charge 3, the corresponding ship is shrouded in smoke in the way intended. This is so because the internal pressure occurring as the active compound burns off is generally greater than the pressure encountered at a depth of water of approximately one meter of $10^4$ N/m$^2$, and so no water 20 can get inside the active charge.

After the active compound 30 has burned off, the loss of gas in the floating aid 14 caused by leakages has the effect that the parts of the active charge 3 that remain in the sea sink.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A smoke munition comprising:

at least one active charge for producing smoke as a protection for ships;

a grenade casing that includes the at least one active charge, the at least one active charge having at least one active compound that produces smoke;

an inflatable floating aid arranged in a front region of the grenade casing;

an igniting device;

an expulsion charge;

a first pyrotechnic delay element; and a priming charge, wherein the igniting device ignites the expulsion charge of the at least one active charge, the expulsion charge ignites the first pyrotechnic delay element, and the first pyrotechnic delay element ignites the priming charge of the at least one active compound, and wherein the igniting device, the expulsion charge, the first pyrotechnic delay element and the priming charge are arranged at a rear region of the grenade casing.

2. The smoke munition as claimed in claim 1, further comprising a second pyrotechnic delay element that is ignited by the priming charge, wherein a gas-producing mixture is arranged inside the at least one active charge such that the gas-producing mixture is activated by the priming charge of the at least one active compound via the second pyrotechnic delay element.

3. The smoke munition as claimed in claim 1, wherein the inflatable floating aid is formed such that in an inflated state the inflatable floating aid prevents the at least one active charge from sinking until a portion of the at least one active compound that produces smoke has converted into smoke.

4. The smoke munition as claimed in claim 1, wherein, in an inflated state, the inflatable floating aid is tire-shaped, sphere-shaped or cushion-shaped.

5. The smoke munition as claimed in claim 1, wherein a telescopic tube device, in a pushed-in state, is arranged in the front region of the grenade casing.

6. A smoke munition comprising:

at least one active charge for producing smoke as a protection for ships;

a grenade casing that includes the at least one active charge, the at least one active charge having at least one active compound that produces smoke; and an inflatable floating aid arranged in a front region of the grenade casing, wherein a telescopic tube device, in a pushed-in state, is arranged in the front region of the grenade casing, and wherein the telescopic tube device has at least two cylindrical tubes enclosed in the pushed-in state by the inflatable floating aid and is non-positively connected to the inflatable floating aid such that, when the inflatable floating aid inflates, the inflatable floating aid actuates the telescopic tube device into a pushed-apart state and combustion products of the at least one active compound that produce the smoke escape into the atmosphere via a space inside the at least two cylindrical tubes of the telescopic tube device.

7. The smoke munition as claimed in claim 5, wherein the smoke munition has, in the front region, a widening in the form of a housing.

8. A smoke munition comprising:

at least one active charge for producing smoke as a protection for ships;

a grenade casing that includes the at least one active charge, the at least one active charge having at least one active compound that produces smoke; and an inflatable floating aid arranged in a front region of the grenade casing, wherein the at least one active charge has a central middle tube formed of a heat-resistant material that extends in a longitudinal direction and is enclosed by the at least one active compound, and wherein an expulsion charge, a first pyrotechnic delay element, and a priming charge are arranged axially one behind the other in the central middle tube, with the first pyrotechnic delay element being arranged between the expulsion charge and the priming charge.

9. The smoke munition as claimed in claim 8, wherein the central middle tube has at a front end an opening for the ignition of a second pyrotechnic delay element.

10. The smoke munition as claimed in claim 1, wherein the smoke munition is a smoke grenade that is adapted to be fired from a conventional launcher.

11. The smoke munition as claimed in claim 2, wherein the second pyrotechnic delay element is arranged at the front region of the grenade casing.

12. The smoke munition as claimed in claim 8, wherein the expulsion charge ignites the first pyrotechnic delay element and the first pyrotechnic delay element ignites the priming charge.

* * * * *